United States Patent [19]

Daumer et al.

[11] 4,140,087

[45] Feb. 20, 1979

[54] METHOD AND APPARATUS FOR GENERATING FUEL INJECTION VALVE CONTROL PULSES

[75] Inventors: Rolf Daumer, Merklingen; Bernd Peter, Kornwestheim, both of Fed. Rep. of Germany; Jean-Michel Castella, Epagny, Switzerland; Harald Kizler, Stuttgart, Fed. Rep. of Germany

[73] Assignee: Robert Bosch GmbH, Stuttgart, Fed. Rep. of Germany

[21] Appl. No.: 742,715

[22] Filed: Nov. 17, 1976

[30] Foreign Application Priority Data

Nov. 18, 1975 [DE] Fed. Rep. of Germany ..... 2551681

[51] Int. Cl.[2] ..... F02B 3/02

[52] U.S. Cl. ..... 123/32 EC

[58] Field of Search ..... 123/32 EB, 32 EC, 32 ED, 123/32 EA

[56] References Cited

U.S. PATENT DOCUMENTS

| | | | |
|---|---|---|---|
| 3,927,304 | 12/1975 | Wentworth et al. | 123/32 EC |
| 4,002,152 | 1/1977 | Hoshi | 123/32 EA |

*Primary Examiner*—Samuel Feinberg
*Attorney, Agent, or Firm*—Edwin E. Greigg

[57] ABSTRACT

The air flow rate and the speed of an internal combustion engine are sensed and translated into pulse trains of variable frequency. During a time interval defined by the rpm related signal, a digital counter receives and counts the air flow rate frequency. Subsequently, the contents of this counter are counted out by a pulse train whose frequency is adjustable depending on other engine conditions such as start-up, warm-up, idling, full-load and the like. The apparatus also includes circuitry for generating a control pulse of minimun length.

17 Claims, 6 Drawing Figures

METHOD AND APPARATUS FOR GENERATING FUEL INJECTION VALVE CONTROL PULSES

BACKGROUND OF THE INVENTION

The invention relates to a method and an apparatus for determining the duration of injection control pulses used to actuate electromagnetic fuel injection valves in an internal combustion engine. The injection valves are opened at times which are synchronous with crankshaft rotations and the length of the time of injection is derived substantially from the magnitude of the air flow rate and from the engine speed (rpm).

Known in the art are fuel injection systems in which the injection control pulse is formed by a monostable multivibrator including a capacitor in a feedback path. In order to obtain a first approximation to a datum defining the fuel injection period, there is disposed within the induction channel of the engine an air flow rate meter of any suitable construction but so embodied as to produce an electrical signal corresponding to the quantity of air taken in by the engine per unit time. In order to obtain an approximately stoichiometric metering of fuel, the signal which is proportional to the air flow rate must be divided by the number of suction strokes per unit time, i.e., by the rpm $n$ of the crankshaft. In the known system, the capacitor in the feedback path of the multivibrator is charged with a constant charging current during a time which is inversely proportional to the crankshaft rpm and, after triggering at a point depending on the rpm, it is discharged with another constant current but one whose magnitude is inversely proportional to the air flow rate. The duration of the discharging process of the capacitor is a measure of the length of the injection pulses.

When fuel injection systems of this type are employed in engines, it is usually necessary to adapt the system to the particular type of engine, and to provide possibilities for adapting the system to the particular number of cylinders in the engine as well as for making other adjustments and connections.

OBJECT AND SUMMARY OF THE INVENTION

It is a principal object of the invention to provide a fuel injection system of the general type described above and so improved as to be universally adaptable to any internal combustion engine and to operate in a highly precise and reliable manner while maintaining relatively low costs.

This and other objects are attained according to the invention by providing a method which includes supplying a counter with a frequency proportional to the aspirated air quantity for a period of time defined by the rpm of the engine. The method further includes counting down the total accumulated in the counter with a frequency which is adjustable and to use the period of time elapsed from the beginning to the end of countdown as a measure for defining the fuel injection duration.

When using this method, any required corrections, such as, for example, for the special conditions obtaining during engine start-up, engine warm-up, idling, full load operation, etc., which may be required to adjust the fuel injection time, can be supplied to the digitally operating central processor by alteration of the counting frequencies. This permits operation with very high frequency, due to the digital manner of the counting while maintaining the cost within reasonable limits even for very precisely adjusted systems.

The invention further provides an apparatus for carrying out the above method.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
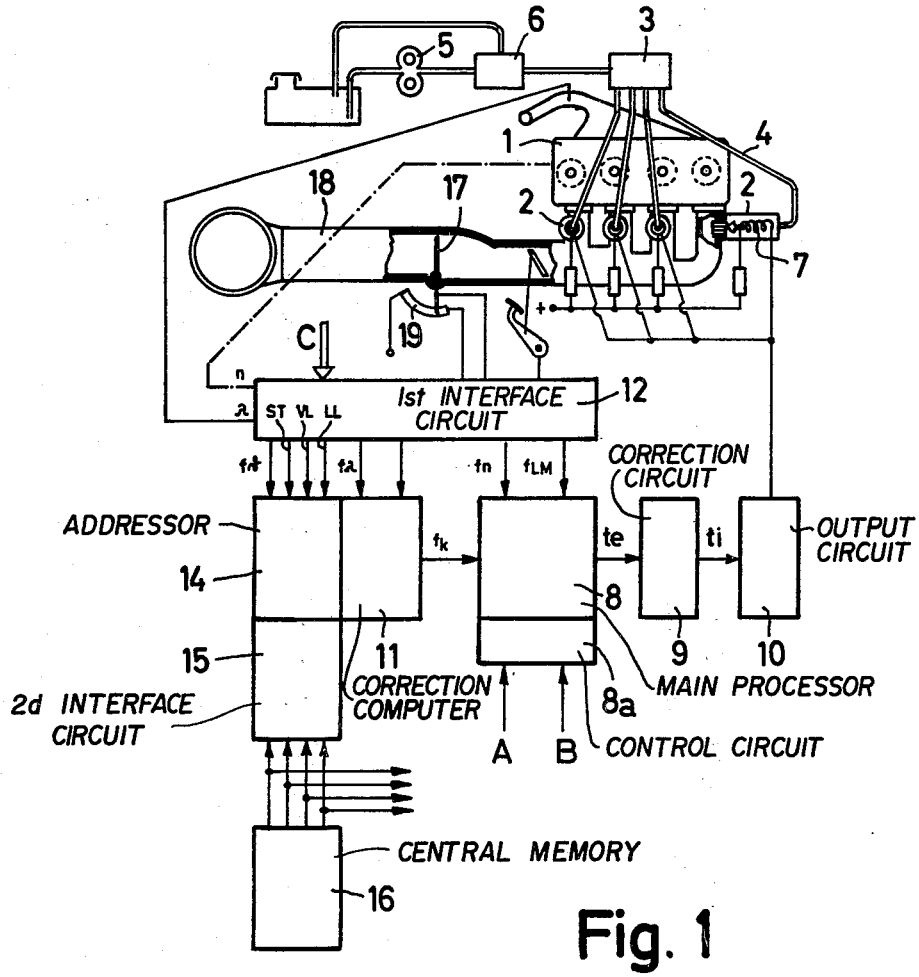
FIG. 1 is a schematic diagram of a fuel injection system according to the invention including portions of an internal combustion engine and a block diagram of the apparatus of the invention.

Turning now to FIG. 1, there is illustrated in schematic form an internal combustion engine with battery ignition and four cylinder, four cycle operation. This type of engine is illustrated only by way of example, and it will be understood that suitable changes and minor alterations may be made to the fuel injection system according to the invention so as adapt it for virtually any type of known internal combustion engine.

The internal combustion engine 1 in FIG. 1 has four fuel injection valves 2 which are supplied with fuel from a fuel distributor 3 via tubulations 4. The fuel is supplied by an electrically driven fuel pump 5 via a pressure regulator 6 which maintains, for example, a gauge pressure of 2 atmospheres. The apparatus further includes an electronic fuel injection system to be described in detail below which defines the duration of fuel injection pulses delivered to the magnetic windings 7 of the injection valves 2 so as to cause them to open for a predetermined period of time during which a suitable quantity of fuel is delivered by the valves, for example into the induction manifold or immediately adjacent the appropriate cylinder of the engine.

The fuel injection system includes a central main processor 8 which generates a series of pulses $t_e$ which define the duration of the fuel control pulses and which is delivered via a voltage correction circuit 9 as new pulses $t_i$ to a final stage 10 which actually operates on the magnetic windings of the valves. The central processor 8, which will be described in greater detail below, has an associated control portion 8*a* which receives input signals A and B for adapting the system to four, six, or eight cylinder engines.

The entire system operates in digital manner and the information fed to the main processor is contained in the form of frequencies. The main processor and other associated computer units which include a correction computer 11 are supplied with switching signals or frequencies by an intermediate circuit 12 which derives them from input signals related to the instantaneous behavior of the engine. Thus, for example, the main processor 8 receives a signal $f_{LM}'$ related to the air quantity, a signal $f_n$ related to rpm and a so-called correction frequency $f_k$ and all of these signals will be described in more detail below. Associated with the correction computer 11 is an addressor 14 which operates through a second intermediate circuit 15 to communicate with a central memory 16 which contains and from which may be taken data related, for example, to the characteristics of the particular engine.

The overall operation in principle of the fuel injection system according to the invention and especially of the main processor 8 will now be described in detail.

Figure 2:
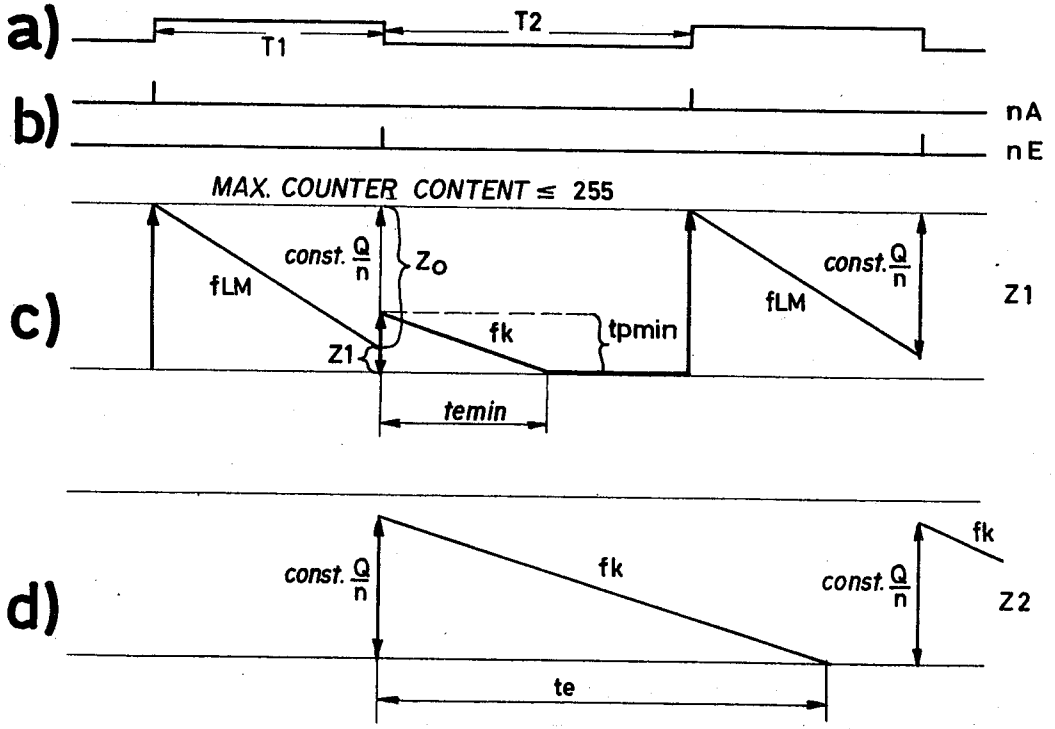
FIG. 2 is a series of timing diagrams for illustrating the events taking place in various parts of the apparatus of the invention.

The first task for the main processor 8 is a calculation of the magnitude of the uncorrected load condition of the engine. This calculation is performed by forming the quotient of the air quantity Q delivered to the engine per unit time and the rpm and to derive from this quotient a pulse length which may be called the uncorrected injection time. For the purpose of this calculation, the main processor receives a frequency which may be called the air quantity frequency $f_{LM}$ which is derived by the intermediate circuit 12, for example from the position of a baffle plate 17 located in the induction channel 18. A suitable signal may be derived at first in analog fashion, for example with the use of a potentiometer 19 and may then be transformed in known manner into a frequency proportional to the potentiometer voltage. This frequency and the rpm-proportional frequency $f_n$ is fed to the main processor 8. An example of an rpm-proportional frequency $f_n$ is illustrated in FIG. 2*a*. This frequency may be generated, for example, by two opposite 60° sectors rotating at the crankshaft rpm which pass an appropriate electronic transducer so as to produce a pulse of duration $T_1$ corresponding to a 60° sector of the crankshaft followed by a portion of the pulse $T_2$ of duration 120°.

In principle, the main processor 8 may be so embodied as to feed the air-related frequency $f_{LM}$ to a counter during the time period $T_1$ after the expiration of which the counter contains a number which is proportional to the value Q/*n*. In order to derive a pulse length, this counter content must then be processed in an appropriate manner, for example by counting downwardly from the number contained in the counter during a second period of time and at a constant or at least correctable frequency, i.e., the frequency labeled $f_K$. The time which elapses from the beginning of the downward count until the original counter content zero is reached, will then be a measure of the desired injection time $t_e$ which is fed by the main processor 8 to the voltage correction circuit 9.

It is a particular advantage of this process that it permits, quite incidentally, taking account of other parameters and conditions of the internal combustion engine during the downward count; for example the correction frequency may take into account the special conditions obtaining during idling, full load, starting, warm-up, altitude, or the condition indicated by an oxygen sensor, i.e., a λ sensor in the exhaust gas for maintaining a stoichiometric fuel-air mixture and other conditions, all with a high degree of precision.

As will be seen from FIG. 1, the intermediate circuit 12, which may also be referred to as an interface circuit, feeds to the main processor 8 data concerning the air quantity (frequency $f_{LM}$) and the rpm-related frequency $f_n$ whereas the other necessary data are contained in the correction frequency $f_K$ which is delivered to the main processor by the correction computer 11.

The present invention is primarily concerned with the construction of the main processor 8 and its associated control circuit 8*a*, and the other systems illustrated in the block diagram of FIG. 1 will not be described here in further detail. It should be mentioned, however, that the correction frequency is a frequency which is used by the main processor 8 for the downward count of its counter content Q/*n* and that it contains supplementary information regarding the already recited operational parameters of the engine and it may also be altered by information taken from the central memory 16.

In a preferred embodiment of the invention, the air quantity frequency $f_{LM}$ is not used to cause the counter in the main processor 8 to count upward from the state 0; rather this frequency is used to count the counter down from a maximum content during the time period $T_1$ as illustrated in FIG. 2*b*. This method is preferred because it is technologically simpler to create NOR gates in integrated circuits.

Figure 3:
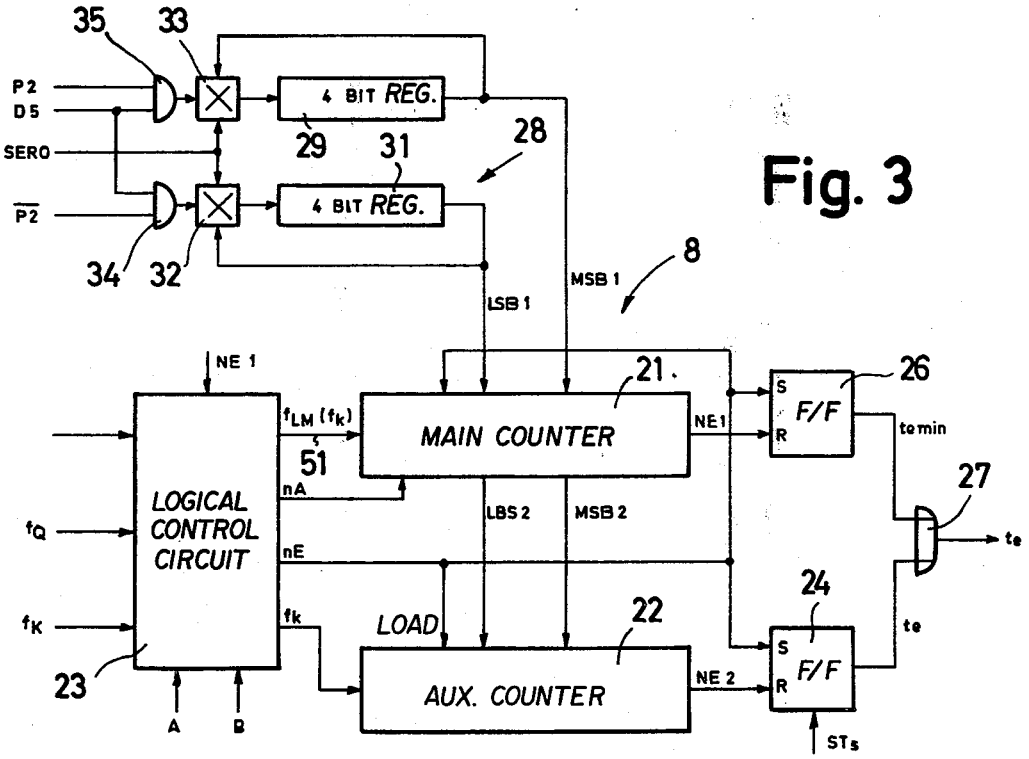
FIG. 3 is a detailed block diagram of the central processor which determines the fuel injection time.

FIG. 3 illustrates the main processor 8 in greater detail. It will be seen to include a main counter 21 and an auxiliary counter 22. Ahead of both counters 21 and 22 there is provided a logical control circuit 23 which receives the correction frequency $f_K$, data concerning rpm according to the voltage curve of FIG. 2*a* as well as air flow rate information corresponding to the frequency $f_Q$. The rpm information as in FIG. 2*a* is used by the logical control circuit 23 to produce two pulse trains *n*A and *n*E which are represented in FIG. 2*b*. The pulse train *n*A defines the onset of the pulses of period $T_1$ whereas the pulse train *n*E defines the end of these pulses. The embodiment illustrated in FIG. 3 contains two counters 21 and 22 although, as will be explained below, somewhat similar results could be obtained using only one counter. However, for several reasons, the use of two counters is preferred. One of these reasons is that the use of two counters provides the possibility of generating a continuous constant signal. By using two counters 21 and 22, it is possible to count downwardly in both counters so that all the decoder and counter indicating circuits are required merely to respond when they reach the state 0 and for this purpose the above-mentioned NOR gates are suited best.

Figure 4:
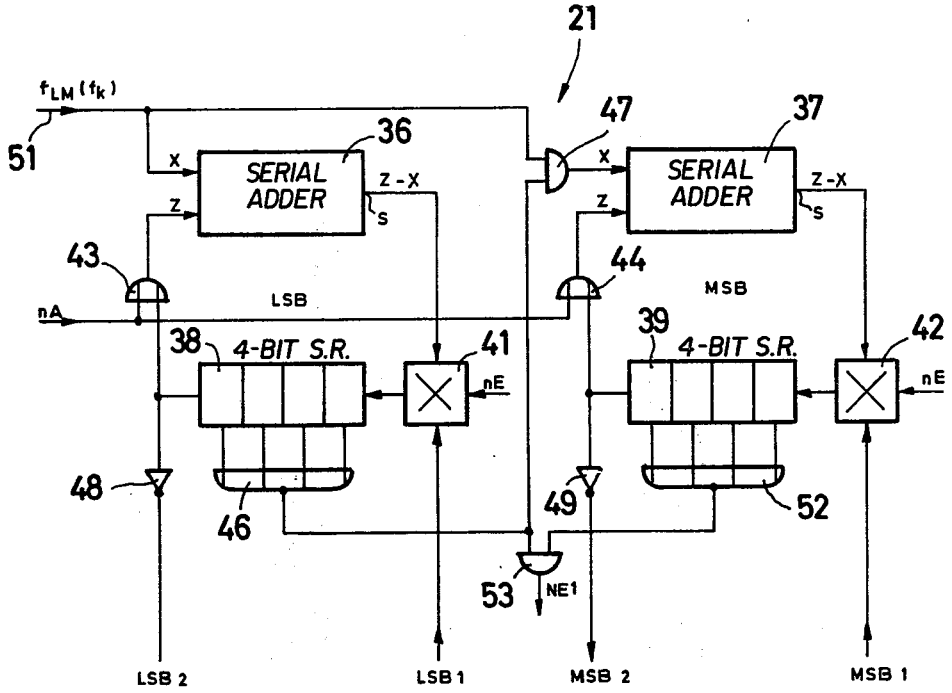
FIG. 4 is a detailed diagram of the main counter in FIG. 3.

As will be seen from FIG. 3, the main counter 21, which is shown in greater structural detail in FIG. 4, is an 8-bit counter which is provided at the beginning of the counting process with a predetermined number which suitably corresponds to its maximum capacity, i.e., the numerical value 255 for an 8-bit counter. The main counter 21 then uses the air quantity frequency $f_{LM}$ to count down its content during a time corresponding to the pulse duration $T_1$. The downward counting of the main counter 21 is terminated at the arrival of the pulse *n*E from the control logic circuit 23 resulting in a counter content Z1 whose complement Z0 corresponds to the desired value, i.e., constant . Q/n. At the time of arrival of a pulse *n*E, the inverted counter content in the main counter 21 is delivered through the lines labeled LSB2 and MSB2 to the auxiliary counter 22 which thus has the content const .(Q/*n*) as may be seen in FIG. 2*d*. As illustrated in FIG. 3, this counter then receives the correction frequency $f_K$ from the logical control circuit 23. During the time period $T_2$ and, if necessary, even during the subsequent time $T_1$, in which the main counter 21 derives a new quotient from Q and *n*, the content of the auxiliary counter 22 is counted downwardly. The duration of this count-down is used to define the pulse length which, in turn, controls the duration of the fuel injection control signals for operating the engine.

As may also be seen from FIG. 3, the *n*E pulse, in addition to providing the command "load" for the auxiliary counter 22 which thus takes over the complement of the content of the main counter 21, the *n*E pulse further switches over two subsequent flip-flops 24 and 26, respectively associated with the counters 22 and 21. The state into which these flip-flops are switched could be so chosen that the output of the flip-flops 24 and 26, which may be bistable multivibrators, exhibits a positive potential during this state. The flip-flops 24 and 26 are returned to their original state by the output signals NE1 and NE2 (so-called zero sensing signals) coming from the counters 21 and 22. The operation of the auxiliary counter 22 is as follows. When this counter has received the complementary content of the main counter 21 and has attained the content zero or some predetermined number after count-down at the corrected frequency $f_K$, that value is sensed by a decoder circuit, which may be a simple NOR gate if the value is zero, which delivers it as a triggering pulse to the subsequent flip-flop 24 which thus returns to its original state. However, during the count-down at the corrected frequency $f_K$, the output of the flip-flop 24 has exhibited the already mentioned positive potential which is equal to the $t_e$ pulse in FIG. 1 and is fed through an OR gate 27 to the output of the main processor 8.

The circuit so far described also illustrates why it is preferable to use two counters 21 and 22 instead of a single up-down counter. During certain operational states and for certain values of the correction frequency, it is possible that the count-down as shown in FIGS. 2*c* and 2*d*, could last a longer period of time than is allowed for the single counter by the pulse $T_2$ related to the rpm data. Thus, if a single counter is used it would not be possible to generate a constant output signal or, put differently, the results would be erroneous. In such a case, the output would follow the relation $$t_e = \text{const.} \cdot Q/n \cdot 1/f_K$$

The illustration in FIG. 2*c* also indicates another very favorable feature of the main processor 8. During the concurrence of unfavorable magnitudes of rpm and load, for example with very high rpm and small load such as occur in downhill operation of a motor vehicle, the duration of the injection control pulse might have to be so small that the metering of the fuel quantity becomes very critical and that the mixture no longer combusts in the cylinders. As a result, these occurs detonation within the exhaust system which is especially disadvantageous for engines which employ exhaust gas detoxication systems, for example catalyzers or after-burners, because the uncombusted fuel is capable of causing substantial damage to such systems.

For this reason, the circuit of FIG. 3 is so embodied as to provide a lower limit for the duration of the injection pulses so that, regardless of the actual values of rpm and air flow rate, the system delivers a pulse $t_{emin}$ which always insures reliable ignition of the fuel-air mixture in the cylinders of the engine. The system illustrated in FIG. 3 utilizes the circumstance that, after the passage of the rear edge of the pulse $T_1$ of the rpm data, i.e., after the arrival of the *n*E pulse, the main counter 21 is free and is not required until the arrival of the *n*A pulse. Since the $t_{emin}$ pulse can be fixed in advance and so as never to exceed the time period $T_2$, it is not objectionable to use the main counter 21 for the formation of the $t_{emin}$ pulse during the time period $T_2$. For this purpose, and after the content of the main counter has been passed on for the formation of the $t_e$ pulse, the counter 21 is reset by the *n*E pulse and set to a predetermined number $t_{pmin}$ which, when counted down at the corrected frequency $f_K$ provides the minimum permissible fuel injection pulse $t_{emin}$. After that, the main counter 21 is read out in the usual manner by a NOR gate after reaching the counter content 0 resulting in a 0-sensing signal NE1 which is fed to the subsequent flip-flop 26. Hence, the flip-flop 26 delivers an output pulse $t_{emin}$ which becomes effective at the output of the OR gate when the normally produced pulse $t_e$ generated by the auxiliary counter 22 in the flip-flop 24 is smaller than the prescribed minimum value.

The binary number which is delivered to main counter 21 at the time of occurrence of the *n*E pulse and which serves for determining the value of the $t_{pmin}$ datum is proportional to this minimum injection magnitude and is a parameter which is essentially related to a particular type of internal combustion engine. For this reason, the main processor in FIG. 3 has an auxiliary memory 28 for storing a binary number corresponding to the value of $t_{pmin}$. In a preferred embodiment of the present invention, the binary number $t_{pmin}$ is a serial word which reaches the auxiliary memory 28 through a line labeled SERO. The auxiliary memory itself consists of two 4-bit registers 29 and 31 with which are respectively associated switch gates 32 and 33. Connected ahead of the switches 32 and 33 are two AND gates 34 and 35, each having two inputs. The binary number corresponding to $t_{pmin}$ is a serial word which is split into two halves, each having 4 bits, and is fed to the registers 29 and 31. The signal D5 defines the point at which the serial word corresponding to $t_{pmin}$ is present on the common data bus SERO. The other input signals P2 and P2 which are fed to the AND gates 34 and 35, are pure multiplex signals which take care of insuring that the first half of the $t_{pmin}$ number goes to the register 29 and the second half goes into the register 31. At the time of occurrence of the *n*E pulse, the main counter 21 interrogates both registers 31 and 29 and accepts their contents via lines marked LSB1 and MSB1 into the main counter 21 which is then counted down in the manner already described at the corrected frequency $f_k$ to obtain the value $t_{emin}$.

The signals labeled A and B received by the logical control circuit relate to the number of engine cylinders and have the effect of obtaining a desired division; the digital fuel injection system is so constructed as to provide one injection pulse for each stroke of the piston. Thus, engines with different numbers of cylinders require a different type of adaptation.

Before dealing in detail with the construction of the individual circuits in FIG. 3, there will now be explained the method of operation of the blocks 11, 14, 15 and 16 in FIG. 1. The central memory 16 contains all of the information related to a particular engine, required to operate the fuel injection system according to the present invention, for example data related to start-up, warm-up, idling, etc. The address generator 14 reacts to input information, such as whether the full-load switch is closed, the idling switch is closed, the starting signal is present or temperature information and delivers an appropriate 8-bit address; for example, the central memory 16 may be an 8-bit memory having 256 locations. The address supplied by the circuit 14 is used by the bus interface 15 for driving a total of four lines illustrated in FIG. 1. In order to simplify the circuitry illustrated, there is not shown a time multiplexer which permits the interrogation of the central memory via the four lines shown and in both directions. If the central memory 16 has empty locations, these may be used to control further single purpose computers such as the main processor 8.

The construction of the main counter 21 is shown in detail in FIG. 4. This counter includes two sequential serial half adders 36 and 37 each of which is in parallel with the shift register 38, 39, respectively, having a capacity of 4-bits in the exemplary embodiment shown. Each serial adder 36, 37 has two inputs X and Z which are supplied with binary words. The binary word supplied to the input Z is the content of the associated shift register 38 or 39 which is cycled at a clock frequency not illustrated but which is greater than the cycling rate of the other two inputs X of the serial adders 36 and 37 by the number of locations of the shift register. In the present exemplary embodiment of the main counter 21 there are used two serial adders with associated shift registers because the maximum counting frequency in the air flow metering can be as high as 150 kHz. Accordingly, the cycling frequency of the shift registers 38 and 39 would be 600 kHz; a pulse from the air flow train $f_{LM}$ or the correction frequency $f_K$ must arrive at the input X of the serial adders 36 and 37 whenever the least significant bit of the content of the shift registers 38 and 39 is present at the input Z of the serial adders 36, 37, respectively.

Figure 5:
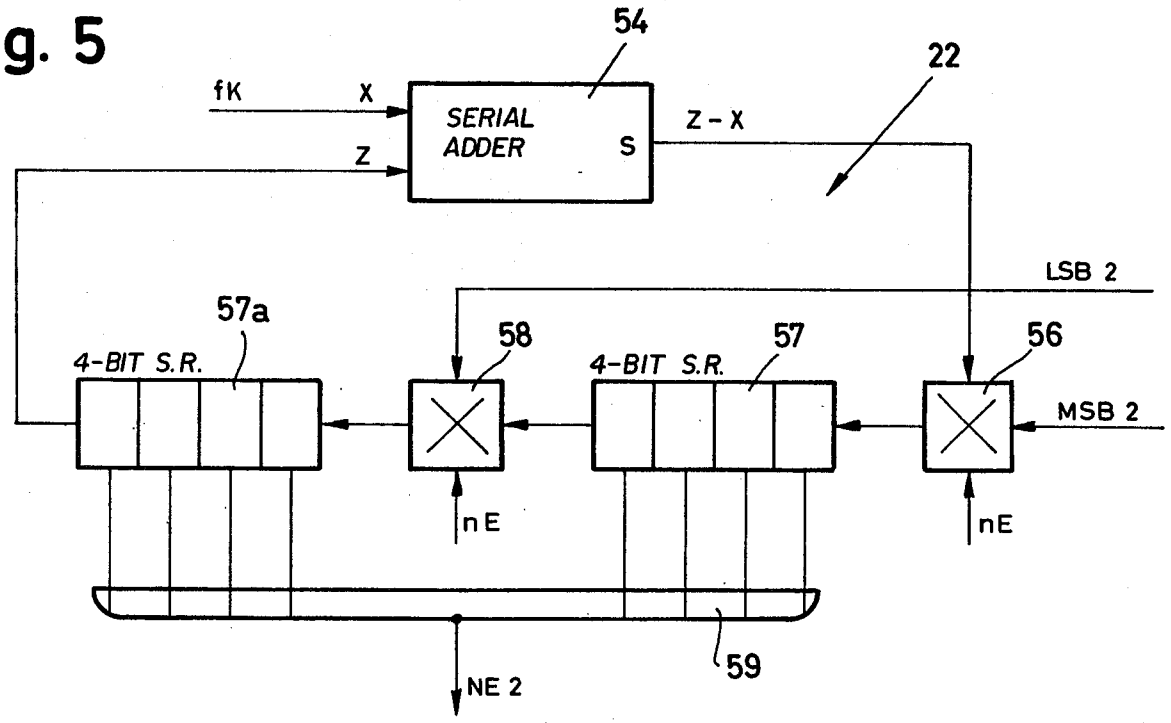
FIG. 5 is a detailed illustration of the auxiliary counter of FIG. 3.

It should be noted that any type of counter could be used in principle as counters 21 and 22 although, in the exemplary embodiments of FIGS. 4 and 5, which are preferred systems, the counters previously described are used because they are especially well adapted to integrated MOS circuit technology. The number of locations of each shift register 38, 39 defines the maximum word length which that shift register can accept; as there are two shift registers 38, 39, the counter in FIG. 4 is an 8-bit counter and the words contained within the shift registers 38, 39 are transported to the input Z of the serial adder at a repetition frequency equal to the shift frequency/the number of shift register locations. The serial adders are either so-called half adders or full adders. In any case, the serial adders 36 and 37 are so embodied as to form an output S as the sum of the prevailing signals at the inputs X and Z and to transport any possible carry amount to the next word location. Thus, the serial adders add a particular pulse from the air data frequency $f_{LM}$ or the correction frequency $f_K$ to the LSB of the word already contained in the associated shift registers 38 or 39. In this manner, the pulses of the frequencies $f_{LM}$ or $f_K$ increase the word content 38, 39 by one unit because the output of the serial adders 36, 37 is connected through switching logic 41, 42, respectively, to the input of the particular shift register 38 or 39 and its output is connected through an OR gate 43, 44 with a Z input of the serial adder. The preceding describes the operation in principle; it has already been noted above that the counting circuits are embodied as downward counters so that the zero recognition circuits may be NOR gates. Hence, in the special exemplary embodiment of FIG. 4, the serial adder operates such that the outputs S of the serial adders 36, 37 which may, perhaps, be better called serial subtractors, always exhibits the difference of the binary word from the registers 38, 39 at the input Z and the counter input at the input X. Thus, the content of the shift registers 38, 39 is reduced at the rate of the counter pulse sequence $f_{LM}$ or $f_K$ which is fed to the input of the main counter 21 in FIG. 4 until a counting cycle is terminated by the arrival of the *n*E pulse, as already explained above.

In each counting cycle, the LSB content of the shift register 38 is counted down to 0 whereupon a 0 recognition circuit, embodied as a NOR gate 46, gives an appropriate output signal to an AND gate 47 which opens and delivers the next counting pulse of the frequencies $f_{LM}$ or $f_K$ to the second serial subtractor 37. This process is repeated periodically until the arrival of the *n*E pulse which defines the end of the time period T1 of the rpm data. The counting process is then blocked and the remaining content of the counter 21 (corresponding to the content of the shift registers 38 and 39) reaches the auxiliary counter 22 via the lines LSB2 and MSB2 as already explained above. This transport takes place due to the switching by the *n*E pulse of the switching gates 41 and 42 in such a manner that the connection between the summing output S of the serial adders 36, 37 is separated from the input of the shift registers 38, 39 while the outputs of the inverters 48 and 49 are connected to the inputs of the shift registers **57, 57*a***. This explanation shows that the transmission of binary words, counter contents and carrying out other arithmetic operations are all done serially so that there is no necessity for tedious parallel-to-serial conversion.

At the same time, the switching gates 41 and 42 separate the summing outputs of the serial adders 36 and 37 from the inputs of the shift registers 38 and 39 and, instead, connect the latter to the LSB1 and MSB1 lines according to FIG. 3 which come from the 4-bit shift registers 31 and 29, respectively. Thus, their content (equal to the binary number $t_{pmin}$) flows to the shift registers 38 and 39 so that, as already mentioned, the main counter 21 is set to the value $t_{pmin}$ at the time of arrival of the pulse *n*E. Simultaneously, there occurs the switch-over of the control logic 23 in FIG. 3 which feeds the correction frequency $f_K$ to the input line 51 of the main counter 21 for the purpose of a downward count which is repeated in the same manner as when supplied with the counting frequency $f_{LM}$ related to the air flow rate.

At the instant at which both 0-recognition circuits, i.e., the NOR gate 46 associated with the shift register 38 and a further NOR gate 52 associated with the shift register 39 sense the digit 0 at all locations, both inputs of an AND gate 53 connected to these two NOR gates receive a signal equal to the 0-recognition signal NE1 as already explained above, meaning that the time $t_{emin}$ has been reached and the flip-flop 26 is returned to its original state. At the same time, the signal NE1 blocks the counting pulses for the main counter 21 via the control logic of FIG. 6. Thus the 0-recognition signal NE1 also serves as an overflow block.

At this moment, the content of both shift registers 38 and 39 is identically 0. In order to charge the registers with the maximum counter content, the second inputs of the above-mentioned OR gates 43 and 44 are provided with the *n*A signal as soon as the downward counting process at the air frequency $f_{LM}$ is supposed to begin. However, under these conditions, the OR gates 43 and 44 have a logical 1 on the inputs which are not connected to the outputs of the shift registers 38 and 39, whereas the other inputs see a logical 0 at the shift clock frequency. An OR gate reacts to these conditions by having a logical 1 at its output so that at the end of the *n*A pulse, both shift registers 38 and 39 are loaded with the maximum counter content. A circuit of this type dispenses with the necessity of having to place a predetermined number into the counter.

The auxiliary counter 22 in FIG. 5 is embodied in a corresponding manner but using only a single serial adder 54. The summing output S of the serial adder 54 is connected via a switching gate 56 to the input of a first 4-bit shift register 57 whose output is connected to a further switching gate 58 which, under normal conditions, connects the output of the shift register 57 with the input of a further 4-bit shift register 57*a* whose output, in turn, is connected to the input Z of the serial adder 54 as was the case with respect to the main counter 21 of FIG. 4. In the present case, the other input X of the serial adder 54 is provided only with the correction frequency $f_K$ which, in the framework of the present exemplary embodiment, has a frequency of only approximately 75 kHz, so that the complicated embodiment of the main counter 21 is not required. The manner of operation of the auxiliary counter 22 of FIG. 5 is the same as that of the main counter 21 of FIG. 4; the switching gates 58 and 56 are also actuated by the *n*E pulses and, if that pulse is present, they transmit the binary words present on the lines LSB2 and MSB2 to the appropriate registers 57 or 57*a* of the auxiliary counter. The downward count at the correction frequency $f_K$ finally results in a counter content of 0 which is sensed by a subsequent NOR gate 59 and which generates a 0-recognition pulse NE2 which is fed to the flip-flop 24 of FIG. 3. With respect to the illustration of FIG. 4, it should be noted that the auxiliary memory 28 for storing the word related to $t_{pmin}$ is a pair of 4-bit circulating registers and, as already mentioned, the control signal D5 insures access to the switching gates 32 and 33 via the AND gates 34 and 35, thereby interrupting the feedback connection of the circulating registers and connecting the input of these registers with the data bus SERO. The signals P2 and P2 only determine the timing and the distribution of the half words which are fed to the storage circuits 31 and 29, i.e., the signal P2 is associated with the half word MSB while the signal P2 is associated with the half word LSB. Any other data words controlled in the central memory 16 for controlling the operation of the internal combustion engine are read out at the required time in the following manner. For example, if one deals with the engine starting process, it is necessary to use an injection period which is independent of the actually measured air quantity and the starting rpm. During the starting process, the electronic system of FIG. 1 generates a start signal STs which, as may be seen from FIG. 3, is fed to the flip-flop 24 and prevents the setting of this flip-flop by the signal *n*E. Thus, only the flip-flop 26 is active and its output signal defines the desired $t_e$ signal via the OR gate 27. During the starting process, the value $t_{pmin}$ which defines the time period $t_{emin}$ and which is fed into the main counter 21 after each count-down is replaced by another value $ST_{t_p}$ taken from the central memory 16. The effective injection time during the starting process is then given by $t_{est} = ST_{t_p} \cdot 1/f_K$. Appropriate control signals D5 insure that the required binary words from the central memory 16 are fed to the auxiliary memory 28 at the appropriate time via the SERO bus.

Figure 6:
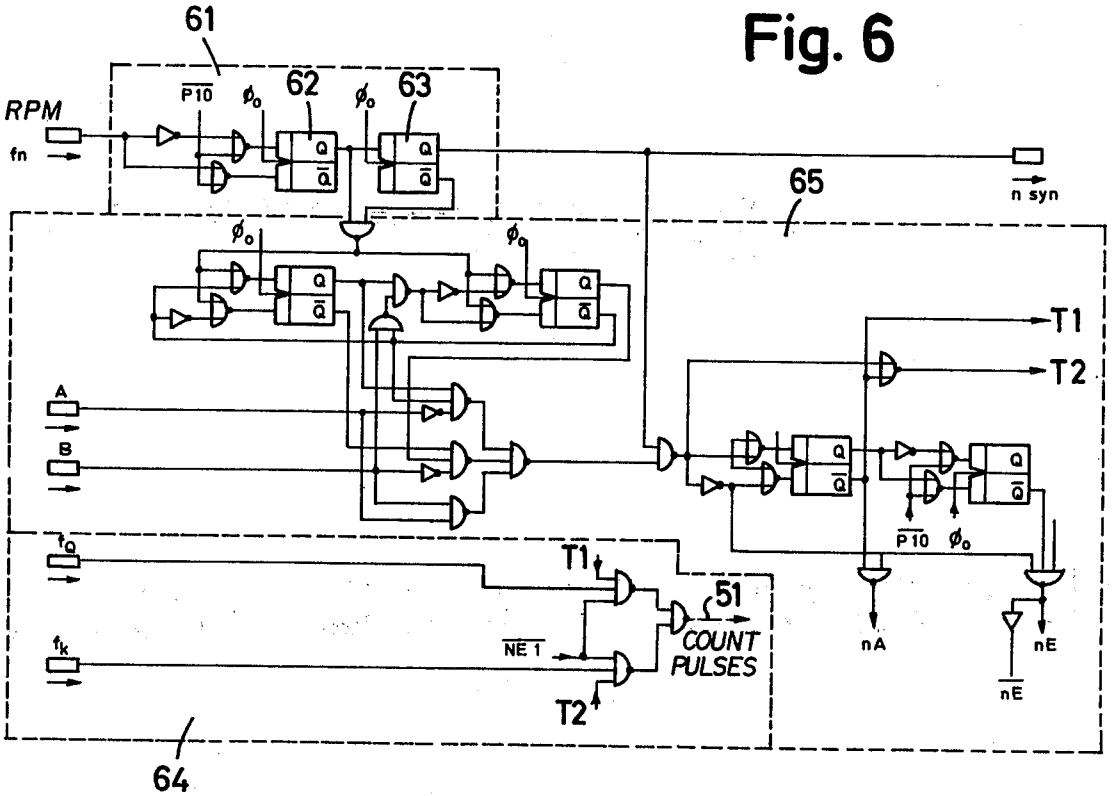
FIG. 6 is a schematic diagram of the logical control circuit in FIG. 3.

The detailed illustration of FIG. 6 defines one possible exemplary embodiment of the logical control circuit 23 of FIG. 3 which may have some other suitable construction. The control logic of FIG. 6 includes, firstly, an upper block 61 which represents a synchronizing circuit and which receives the rpm signal generated by the signal generator 20. It will be seen that this rpm signal must be interlaced with the basic cycling rate of the digital arithmetic system of FIG. 1. For this purpose, the synchronizing circuit 61 receives the basic cycle rate $\phi_o$ and also the definition of the cycling raster via an information signal P1C. The circuit 61 includes two sequential flip-flops 62 and 63 which directly receive the basic cycling rate $\phi_o$ and which receive the rpm information and the raster information via appropriate coupling circuits which are not described in further detail. The synchronizing logic 61 may be said to interrogate the rpm information present at its input; if the raster and the basic cycling rate are present simultaneously, this information is received and transmitted. The logical circuit of FIG. 6 further includes switching logic 64 which receives the air data frequency $f_Q$ and the correction frequency $f_K$ as inputs. This switching logic is so embodied that its output at line 51 carries the counting pulses to be fed to the main counter 21, i.e., the air data frequency $f_{LM}$ for example. Alternatively, it may carry the correction frequency if the content of the counter 21 to be counted down is the $t_{pmin}$ word. The switching logic also receives the values $T_1$ and $T_2$ related to the synchronized rpm data and is further connected so that, during the pause between the pulses of the rpm information according to FIG. 2*a*, it supplies the correction frequency, whereas, during the time of the pulses of the rpm data, it supplies the air data frequency $f_{LM}$. The remaining coupling circuits 65 comprise substantially a divider circuit which takes the rpm data and the two signals A and B which define the manner of operation and produces output control signals which are required by the electronic fuel injection system, namely the time synchronous signals $T_1$ and $T_2$ and the front and rear edge signals *n*A and *n*E derived therefrom. It will be understood that if dealing with an 8-cylinder engine, these output signals $T_1$, $T_2$, *n*A and *n*E will occur at different times and with different frequency than would be the case in a 4-cylinder engine.

The foregoing relates to preferred exemplary embodiments of the invention, it being understood that other embodiments and variants thereof are possible within the spirit and scope of the invention, the latter being defined by the appended claims.

What is claimed is:

1. An apparatus for controlling the opening times of the fuel injection valves of an internal combustion engine, said engine including an induction manifold and means for opening said injection valves in synchronism with the speed of the engine, comprising:

means for generating a first pulse train having a frequency related to the air flow rate through said induction manifold;

means for generating a second pulse train related to engine speed;

a counter for counting the pulses in said first pulse train;

means for deriving start and stop pulses from said second pulse train and for delivering them to said counter to thereby define the counting interval of said counter;

means for generating a third pulse train the frequency of which is variable and which is applied to said counter for counting in the reverse sense as when counting said pulses of said first pulse train;

a content-responsive circuit for interrogating said counter and for providing a content triggered signal when the contents of said counter have a predetermined value; and bistable circuit means, for providing an injection control signal between the time of arrival of said stop pulse from said second pulse train and the time of arrival of said content-triggered signal.

2. An apparatus as defined by claim 1, further including an intermediate circuit for receiving signals related to the prevailing operational state of the engine and constituting said means for generating first and second pulse trains and further including a corrector circuit which receives from said intermediate circuit frequencies related to additional operational variables of the engine, and further including an addressor circuit associated with said corrector circuit and an adjacent intermediate circuit, said addressor circuit receiving signals from said first intermediate circuit to thereby take from a central memory stored serial binary data for delivery to said correction circuit; whereby said correction circuit adjusts said third pulse train fed to a main processor.

3. An apparatus for controlling the opening times of the fuel injection valves of an internal combustion engine, said engine including an induction manifold and means for opening said injection valves in synchronism with the speed of the engine comprising:

means for generating a first pulse train having a frequency related to the air flow rate through said induction manifold;

means for generating a second pulse train related to engine speed;

means for deriving start and stop pulses from said second pulse train;

a main counter circuit including means for setting the contents thereof to an arbitrary value;

switch means for admitting said first pulse train to said main counter circuit for counting down the contents thereof;

an auxiliary counter circuit for receiving from said switch means the complement of the contents of said main counter circuit;

means for generating a third pulse train, the frequency of which is variable and which is applied by said switch means to said auxiliary counter circuit for counting down the contents thereof;

a null detector, connected to said auxiliary counter for providing a null signal when the contents of said auxiliary counter are identically zero; and bistable circuit means, for providing an injection control signal between the time of arrival of said stop pulse from said second pulse train and the time of arrival of said null signal.

4. An apparatus as defined by claim 3, including an auxiliary memory which at the time of transfer of the contents of the main counter into the auxiliary counter transmits to the main counter a number for count-down at said third pulse train frequency; whereby the duration of said count-down constitutes the minimum time for an injection pulse, said apparatus further including a central memory which delivers said number to said auxiliary memory.

5. An apparatus as defined by claim 4, including a second bistable circuit element connected to the output of said main counter, which is set by said switch means at the time of transfer of the counter content from said main to said auxiliary counter and which is reset by a logical 0-sensing circuit associated with said main counter.

6. An apparatus as defined by claim 5, further including an OR gate whose inputs are connected to the outputs of said two bistable circuit means and whose own output constitutes the output of the processor portion of said apparatus.

7. An apparatus as defined by claim 3, wherein the auxiliary memory associated with said main counter circuit includes two 4-bit shift registers for storing half words, connected behind switching circuitry, the outputs of said shift registers being connected to their inputs, thereby forming ring storage circuits, and said switching circuits being so embodied that, upon receipt of an appropriate control signal, said ring storage circuits are opened and information in the form of 8-bit words is transmitted via a central information bus to said shift registers in serial manner.

8. An apparatus as defined by claim 7, wherein said information bus is connected directly to said switching circuits, said switching circuits being switched by the output signals from two prior AND gates, one each of said AND gates receiving a transfer signal for transfering a serial word from said central memory to said auxiliary memory, whereas the other of the inputs of each AND gate receives timing signals; whereby a serial half word is transferred into each of said shift registers.

9. An apparatus as defined by claim 8, wherein said main counter circuit includes a serial adder and a parallel shift register of suitable capacity.

10. An apparatus as defined by claim 9, wherein said main counter circuit includes a first serial adder and a parallel shift register and a subsequent second serial adder with a parallel shift register, the serial adders being so embodied that one of their inputs is connected to the output of the parallel shift register while the other of their inputs is supplied with said first pulse train or said third pulse train; whereby the output of each serial adder carries the difference between the word from the associated shift register and the counting pulse fed to its other respective input.

11. An apparatus as defined by claim 10, wherein said shift registers associated in parallel with said serial adders are 4-bit shift registers which may be supplied with a clock frequency which is greater by the number of locations of said shift registers than the pulse train present at the other input of the serial adders, and further including switching circuitry between the output of said serial adders and the input of said shift registers, said switching circuits being so embodied that, at the arrival of said stop pulse, the output of said serial adders is separated from the input of said shift registers and said shift registers receive the content of the associated 4-bit register of said auxiliary memory.

12. An apparatus as defined by claim 11, wherein the output of the first shift register containing the LSB portion of the main counter is connected to a subsequent NOR gate whose output is connected to an AND gate the other input of which receives said first and third pulse trains and the output of which is connected to the counting input of said second serial adder.

13. An apparatus as defined by claim 11, wherein the outputs of said shift registers which are in parallel with said serial adders are connected with one input of OR gates, the other inputs of which receive said start pulse and the output of which is connected to the input of said serial adders.

14. An apparatus as defined by claim 13, further including inverters connected to the output of said shift registers, the output of said inverters being connected to further switching circuits associated respectively with the inputs of effectively sequential 4-bit shift registers, said 4-bit shift registers being parallel with a single serial adder, the other, uncommitted input of which receives said third pulse train; whereby said single serial adder and the associated parallel 4-bit shift registers constitute said auxiliary counter circuit.

15. An apparatus as defined by claim 14, further including an OR gate for sensing the 0-content of the shift registers of said auxiliary counter, and for generating a 0-sensing signal which may be fed to said bistable circuit means.

16. An apparatus as defined by claim 3, including a central memory, the contents of which may be transferred to said auxiliary memory, whereby the data in said central memory may be transferred into said auxiliary counter to thereby define the duration of fuel control pulses for engine starting after count-down at the frequency of said third pulse train.

17. An apparatus for controlling the duration of the opening times of electromagnetically actuated injection valves with injection control commands supplied to an internal combustion engine, wherein the injection valves are opened synchronously with respect to the camshaft revolutions of the internal combustion engine and the duration of opening times being defined primarily by the air quantity supplied to the internal combustion engine and the rpm, comprising:

a main processor for generating an impulse duration corresponding to the duration of injection control commands including a counter, means for supplying a counting frequency proportional to the supplied air quantity per stroke to said counter during a first time period of an rpm information signal, means for supplying a variable correction frequency to said main processor to carry out a counting procedure in a reverse manner in said counter, a first intermediate circuit for supplying a counting frequency proportional to the air quantity and an impulse series proportional to the rpm to said main processor, a correction computer for generating said variable correction frequency, an addressor circuit, means including said first intermediate circuit for supplying engine status values including engine start-up, engine warm-up, idling, full load operation, exhaust gas composition and the like pertaining to the internal combustion engine to said addressor circuit, a second intermediate circuit, a central memory addressable by said addressor circuit through said second intermediate circuit for receiving data specific to a particular internal combustion engine and means for supplying said data to said correction computer for the generation of said correction frequency.

* * * * *